US009801263B2

(12) United States Patent
Siegel et al.

(10) Patent No.: US 9,801,263 B2
(45) Date of Patent: Oct. 24, 2017

(54) LIGHTING SYSTEM AND METHOD FOR OPERATING A LIGHTING SYSTEM HAVING AN INTEGRATED SAFETY CONCEPT

(71) Applicant: ZUMTOBEL LIGHTING GMBH, Dornbirn (AT)

(72) Inventors: Martin Siegel, Bodolz (DE); Walter Werner, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 15/117,646

(22) PCT Filed: Feb. 5, 2015

(86) PCT No.: PCT/EP2015/052387

§ 371 (c)(1),
(2) Date: Aug. 9, 2016

(87) PCT Pub. No.: WO2015/121143

PCT Pub. Date: Aug. 20, 2015

(65) Prior Publication Data

US 2016/0353557 A1 Dec. 1, 2016

(30) Foreign Application Priority Data

Feb. 11, 2014 (DE) ..... 10 2014 202 445

(51) Int. Cl.
*H05B 37/02* (2006.01)

(52) U.S. Cl.
CPC ..... *H05B 37/0272* (2013.01); *H05B 37/0281* (2013.01)

(58) Field of Classification Search
CPC ..... H05B 37/0272; H05B 37/0281
(Continued)

(56) References Cited

U.S. PATENT DOCUMENTS 6,114,812 A * 9/2000 Lee ..... H05B 37/0272 315/156
6,892,168 B2 * 5/2005 Williams ..... H05B 37/0245 315/133

(Continued)

FOREIGN PATENT DOCUMENTS

DE 102004039677 12/2005
DE 102010020960 11/2011

(Continued)

OTHER PUBLICATIONS

International Search Report for PCT/EP2015/052387, English Translation attached to original, Both completed by the European Patent Office dated May 7, 2015, All together 5 Pages.

(Continued)

*Primary Examiner* — Douglas W Owens
*Assistant Examiner* — Syed M Kaiser
(74) *Attorney, Agent, or Firm* — Brooks Kushman P.C.

(57) ABSTRACT

A lighting system having an operating device and a plurality of lamps. The operating device serves to control the lamps. Each of the lamps has an identification transmitting unit, which serves to control the particular lamp at least temporarily in such a way that the particular lamp outputs an identification light signal to be uniquely identified. An identification receiving unit, which receives the identification light signals of the lamps, is integrated in the operating device. The lighting system is designed in such a way that only lamps whose identification light signal is presently received by the identification receiving unit of the operating device at the time of the output of a control signal for controlling the lamps or within a defined time period therebefore can be controlled.

19 Claims, 6 Drawing Sheets

(58) Field of Classification Search
USPC ..... 315/97, 151, 250, 214 R; 340/553, 534
See application file for complete search history.

(56) References Cited

U.S. PATENT DOCUMENTS

| | | | | |
|---|---|---|---|---|
| 8,138,690 | B2 * | 3/2012 | Chemel | F21V 17/02 315/294 |
| 8,339,069 | B2 * | 12/2012 | Chemel | H05B 37/029 315/294 |
| 8,373,362 | B2 * | 2/2013 | Chemel | H05B 37/029 315/291 |
| 8,543,249 | B2 * | 9/2013 | Chemel | H05B 37/0272 351/51 |
| 8,581,707 | B2 * | 11/2013 | Bucci | G08C 17/02 340/10.1 |
| 8,954,170 | B2 * | 2/2015 | Chemel | H05B 37/029 315/297 |
| 2006/0049935 | A1 * | 3/2006 | Giannopoulos | H05B 37/02 340/533 |
| 2008/0203928 | A1 * | 8/2008 | Frumau | H05B 37/029 315/151 |
| 2009/0112366 | A1 | 4/2009 | Jahn et al. | |
| 2011/0109445 | A1 | 5/2011 | Weaver et al. | |
| 2011/0140864 | A1 | 6/2011 | Bucci | |
| 2013/0009036 | A1 | 1/2013 | Yianni et al. | |
| 2014/0327364 | A1 | 11/2014 | Bischof et al. | |

FOREIGN PATENT DOCUMENTS

| | | |
|---|---|---|
| DE | 102011007416 | 10/2012 |
| WO | 2006111927 | 10/2006 |
| WO | 2006111934 | 10/2006 |
| WO | 2010079400 | 7/2010 |
| WO | 2012090122 | 7/2012 |
| WO | 2013028711 | 2/2013 |
| WO | 2013075154 | 5/2013 |

OTHER PUBLICATIONS

German Search Report for German Application No. DE 102014202445.5, Completed by the German Patent Office, dated Sep. 25, 2014, 8 Pages.

* cited by examiner

LIGHTING SYSTEM AND METHOD FOR OPERATING A LIGHTING SYSTEM HAVING AN INTEGRATED SAFETY CONCEPT

CROSS-REFERENCE TO RELATED APPLICATION

This application is the U.S. national phase of PCT Application No. PCT/EP2015/052387 filed on Feb. 5, 2015, which claims priority to DE Patent Application No. 10 2014 202 445.5 filed on Feb. 11, 2014, the disclosures of which are incorporated in their entirety by reference herein.

The invention relates to a lighting system and an operating method for lighting systems which use a communication based on visible light.

In principle, it is known to control light management systems by means of wireless communication. However, these systems have the disadvantage that unauthorized persons can also intrude into the radio system or can access the latter and thus unauthorized access or unauthorized control of the entire system or of individual lamps can be performed. In addition, the known systems are disadvantageous since lamps located outside the range of vision of the user can also be controlled accidentally by a user authorized in principle although this does not correspond to the wish of the user or it is outside his authorization.

The known systems thus have an access problem if, for example, it is possible to access the system from outside and a number of rooms can be activated. This is problematic especially if a complete building can be activated with the lighting control. Furthermore, it has hitherto been known to grant access rights to particular rooms or groups of rooms to individual groups of users. However, this requires unambiguous identification of the corresponding lamps and manual assignment of user rights. It may indeed be possible to prevent unauthorized access by means of such a method, but not unintended access. In particular, it is not possible to prevent by this means the wrong operation of lamps in adjacent rooms which are not visible.

Thus, for example, German laid-open specification DE 10 2011 007 416 A1 shows a corresponding lighting system having control of the lamps by means of radio.

The invention is based on the object or providing a lighting system and a method for operating a lighting system which prevent unauthorized control and unintentional control and at the same time, provide for simple and intuitive control.

According to the invention, the object is achieved by the features of independent claim 1 for the device and by the features of independent claim 15 for the method. Advantageous developments are the subject matter of the subclaims referring back to these.

A lighting system according to the invention contains an operating device and a plurality of lamps. In this arrangement, the operating device is used for controlling the lamps and is preferably designed as a mobile device (e.g. Smartphone preferably incl. corresponding App). Each of the lamps has an identification transmitting unit which serves to control the respective lamp at least temporarily in such a manner that the particular lamp delivers an identification light signal to be unambiguously identified. An identification receiving unit (for example a camera), which receives the identification light signals of the lamps, is integrated into the operating device. In this context, the lighting system is designed in such a manner that only the lamps, the identification light signal of which is presently received—that is to say at the time of delivery of a control signal—by the identification receiving unit of the operating device or has been received within a defined period (first period) before, can be controlled. This ensures that, on the one hand, only lamps within the visible range of the operating device can be controlled and, on the other hand, only persons having access to the room can perform controlling of the lamps.

Within the scope of the invention, a "defined period" is understood to be, in particular, a period which, for example, is predetermined—that is to say previously specified—lamp-specifically (that is to say specified individually for each lamp) or (at least partially) lamp-independently (that is to say specified for several or all lamps jointly) or which, for example, is determined situation-dependently (automatically); for example due to a position of a lamp in the room, a detected actuation of a lamp, of the operating device itself (for example due to operating-device-specific actuating rights), (clock)-time dependently etc.

By means of the system according to the invention, an additional safety feature which provides for an unambiguous correlation between user, lamp and room, which offers a simple and consistent access and safety system for a light control, is provided on the basis of a linkage of (wireless) light control (e.g. radio-based) with a communication based on optical signals (e.g. Visible Light Communication (VLC)). At the same time, it can be ensured that there will be no execution of unauthorized or unwanted control commands when, e.g., the user wishes to activate lamps in a remote room.

The lighting system preferably also has a database in which the identification light signals and/or signals derived therefrom (e.g. digital signals) of the respective lamps and additional information of the respective lamps are stored. The operating device is then designed in order to retrieve at least a part of the additional information of the respective lamps after reception of an identification light signal by means of an inquiry from the database and/or exclusively to control a lamp (10-18) unambiguously allocated to the identification light signal or the derived signal—preferably in the database. Thus, authorizations for controlling the lamps can be checked in a very simple manner and only those lamps can be activated which have been authenticated as activatable in the given situation by equalization of signals or signal information, eg. by means of information deposited in a database.

The additional information of the respective lamps preferably contains a lamp addressing. The operating device is then designed to control the respective lamp by means of its lamp addressing. Thus, the lamp can be controlled in a very simple manner without prior knowledge about the lamp.

The additional information of the respective lamps preferably contains a position of the lamp. In this case, the operating device has a display unit which is designed to display the positions of the lamps. This provides for very intuitive operation.

The additional information of the respective lamps preferably contains available control options of the lamp. The control options are then a switching state and/or a dimming state and/or a color temperature and/or a lighting sequence. The operating device is then designed to display available control options only for the respective lamp by means of a display unit. This improves the clarity of representation and thus simplifies the operation.

The operating device preferably has a wireless communication interface. The controlling of the lamps by the operating device then occurs by means of the wireless communication interface of the operating device. This provides for mobile operation. For example, a smartphone having a corresponding App and WLAN module can be used as such an operating device.

The operating device is advantageously designed to perform a control only of lamps the respective identification light signal of which the operating device is currently receiving. Thus, incorrect operation of lamps not within the visible range can be avoided.

The operating device can preferably be designed to send control commands for controlling the lamps and signals derived from the received identification light signals by means of the communication interface of the operating device to a communication interface corresponding with the lamps in terms of control (e.g. of a (central) controller or the lamps themselves). The lighting system is then designed in such a manner to accept a control of a lamp via the operating device only when the derived signal can be unambiguously allocated to the identification light signal of this lamp, wherein the derived signal can be unambiguously allocated to a lamp to be controlled or its identification light signal preferably on the basis of the database (43) stored in the lighting system. In this way, it is possible to use known, preferably wireless communication interfaces in order to perform reliable authentication and control of lamps within an authorization room area.

The lamps preferably have in each case a wireless communication interface (e.g. WLAN module). The lamps are then controlled by the operating device directly by means of the wireless communication interfaces of the operating device and of the lamps. Thus, an expensive central controller can be omitted especially in the case of small installations having few lamps. The receiving module of the lamp can detect its own frequency pattern and can be activated in accordance with the control commands of the operating device in this case.

In this context, the operating device is preferably designed to send signals derived from received identification light signals to the lamps by means of the wireless communication interfaces. The lamps are then designed to accept a control via the operating device only when the respective lamp receives a signal derived from the identification light signal sent out by it. Incorrect operation can thus be avoided even more reliably.

The lamps are advantageously designed, in the case of a control of the respective lamp, starting from an off-state off the lamp, to switch, independently of a transmission of a signal derived from the associated identification light signal, into a switched-on state for a second period of time and during this period to send out the identification light signal by means of the identification transmitting unit of the lamp and to change back into the switched-off state if there has been no transmission of a signal derived from the associated identification light signal by the end of the second period of time. Thus, there can also be an operation starting with a switched-off lamp but, at the same time, incorrect operation can be avoided.

Optionally, the lamps are then designed not to respond to a control by the operating device during a third period of time preferably following the second period of time directly, after the second period of time has elapsed. The result is that an unauthorized user cannot easily switch a lamp on or control a lamp several times in succession.

In an alternative embodiment, the lighting system has a control device which has a wireless communication interface (e.g. WLAN module) for communication with the operating device. The control device is then designed to control the lamps directly and the operating device is designed to control the lamps indirectly via the control device. The operating device is then designed to send signals derived from received identification light signals to the control device by means of the wireless communication interfaces. In this case, the control device is designed to control a lamp only when the control device receives a signal derived from the identification light signal of the lamp sent out. This also eliminates unauthorized operation. A system having a central controller is appropriate particularly in the case of large installations having numerous lamps because it is then possible to dispense with expensive wireless communication interfaces in the lamps.

The control device is preferably designed, in the case of an operation of the respective lamp by the operating device, starting from a switched-off state of the lamp, to switch, independently of a transmission of a signal derived from the associated identification light signal, the lamp into a switched-on state for a second period of time. The lamp is then designed to send out its identification light signal by means of the identification transmitting unit in the meantime. The lamp is again switched into the switched-off state if there has been no transmission of a signal derived from the associated identification light signal by the operating device up to the end of the second period of time. This avoids unauthorized operation also starting from a switched-off state of the lamp.

The control device is optionally designed not to respond to an operation of the lamps by the operating device during a third period of time preferably directly following the second period of time after the second period of time has elapsed. This impairs or avoids continuous activation by an unauthorized user.

The lighting system is preferably designed in such a manner that only lamps are controllable, the respective identification light signals of which are received by the identification receiving unit of the operating device with a light intensity which is greater than a predetermined threshold value. This avoids incorrect operation in the case of optically linked rooms. An adjustment of this threshold value by the user is also conceivable.

A method according to the invention is used for operating a lighting system having an operating device and a plurality of lamps. The operating device controls the lamps in this arrangement. The lamps at least temporarily deliver an identification light signal unambiguously identifying the respective lamp. Identification light signals of the lamps are received by the operating device. The operating device only controls lamps, the identification light signal of which is received by the operating device at the time of delivery of a control signal for controlling the lamps or within a defined period of time before. This reliably avoids incorrect operation.

In the text which follows, the invention will be described by way of example by means of the drawings in which an advantageous exemplary embodiment of the invention is shown. In the drawings.

Figure 1:
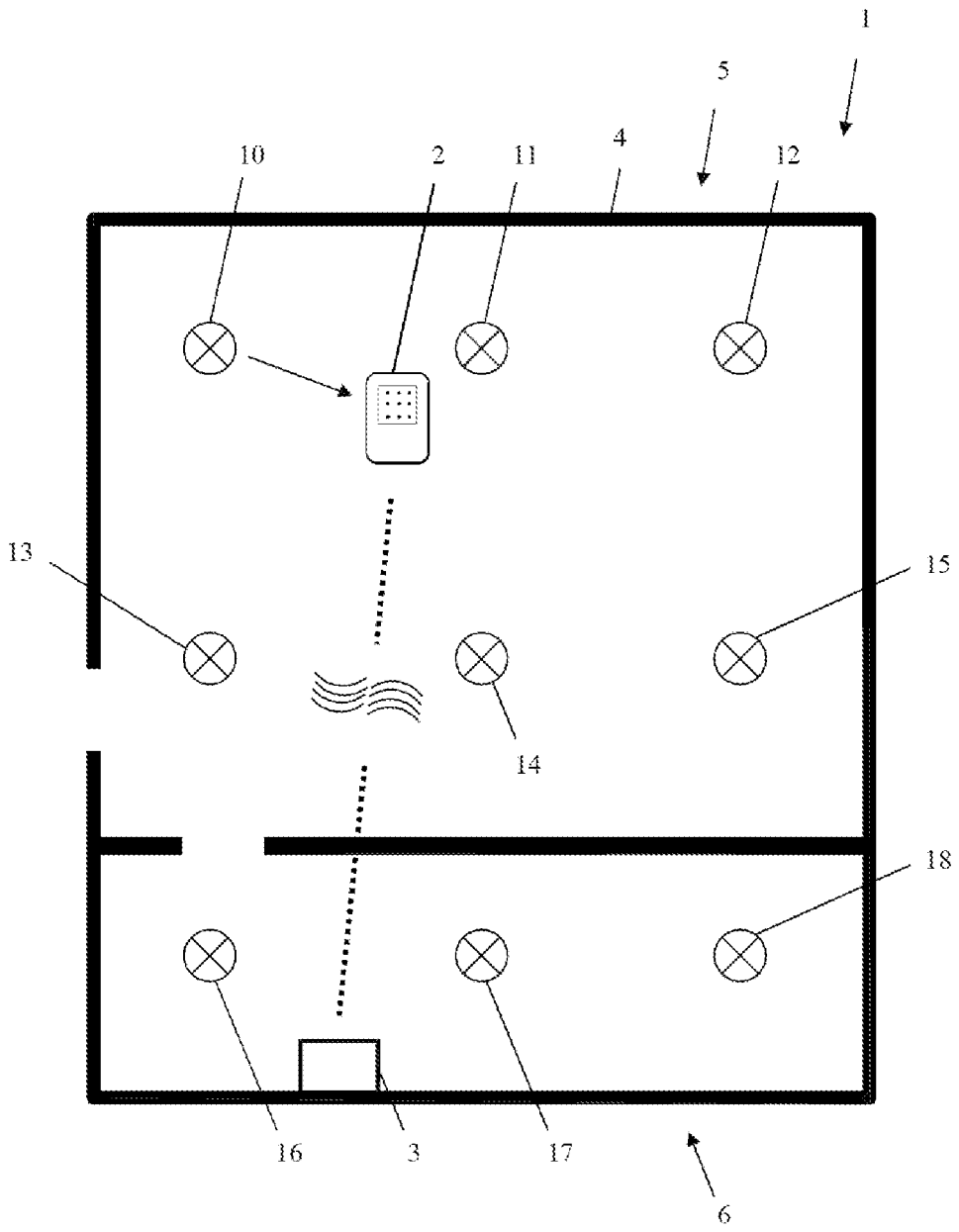
FIG. 1 shows an exemplary embodiment of the lighting system according to the invention in a top view.

Firstly, the fundamental problems and the general structure of an exemplary embodiment of the lighting system according to the invention is shown by means of FIG. 1. By means of FIGS. 2-4, the detailed structure and the detailed operation of the exemplary embodiment is subsequently explained. Following this, the operation of exemplary embodiments of the method according to the invention is discussed in detail by means of FIG. 5 and FIG. 6. Identical elements have partially not been represented and described repeatedly in similar figures.

In FIG. 1, an exemplary embodiment of the lighting system 1 according to the invention is shown in a top view. The lighting system 1 contains an operating device 2, preferably a controller 3, and a plurality of lamps 10-18. The lighting system 1 is preferably arranged in a building 4 having a first room 5 and a second room 6. The lamps 10-15 are arranged in the first room 5, whereas lamps 16-18 are arranged in the second room 6. The operating device 2 is presently located in the first room 4. It is preferably a mobile operating device such as, e.g. a tablet PC, a smartphone etc. The controller 3 is arranged in the second room 6 in the exemplary embodiment shown here. It is usually a permanently installed (central) controller. The lamps 10-18 are preferably connected to the controller 3 by means of a wire-connected link, a wireless link, e.g. WLAN modules present in the controller and in the lamps also being conceivable, in principle. Preferably, a bus system, e.g. according to the DALI standard, is used. The operating device 2 and the controller 3 are preferably connected to one another by means of a wireless link. The operating device 2 is here located within direct visual range of the lamps 10-15. In addition, it can receive light from lamps 16 from the second room 6 connected via a passage.

The lamps 10-18 in each case contain an identification transmitting unit which causes the respective lamp to send out an identification light signal at least temporarily by means of which the respective lamp 10-18 can be identified unambiguously. These identification light signals are received by the operating device 2 by means of an identification receiving unit.

In a simplest embodiment of the lighting system, the operating device 2 only controls lamps 10-18, the identification light signals of which can just be received by the operating device 2. In the exemplary embodiment shown here, control is effected by means of the wireless communication interface and the controller 3. As will be explained in detail in the text which follows, such an embodiment prevents unauthorized and/or accidental incorrect operations since, for example, the identification light signals of lamps 17 and 18, which are located obscured in the second room 6, cannot be received by the operating device 2.

By means of an authentication between the operating device 2 and the respective lamp 10-18, an unauthorized access can be reliably avoided in this arrangement. In this case, the operating device 2 sends, together with an operating signal, a signal derived from the identification light signal of the lamp to the control device. The control device checks whether the identification light signal or the correspondingly derived signal matches the desired control of a lamp and then controls exclusively the lamp(s) allocated to the signals. In an exemplary embodiment without central controller 3, the operating device can send the signal (either a derived signal or an (identical) identification light signal) directly to the respective lamp which receives the signal (e.g. by means of corresponding sensors) and performs the check.

In order to ensure that lamps located in a room partially visually joined are not accidentally controlled, the operating device 2 is preferably designed in such a manner that it only controls lamps 10-18, the identification light signals of which are received with at least a particular light level (light intensity or the like) above a predetermined threshold value. In the exemplary embodiment shown here, this is particularly relevant in the case of lamp 16 since the latter is visible for the operating device 2 through the passage from the first room 5.

The lighting system 1 preferably also has a database in which, apart from the identification light signals of the respective lamps, additional information relating to the respective lamps can also be stored. Thus, for example, the positions of lamps 10-18 can be stored there (e.g. in an installation map), but also possible control options for the respective lamps 10-18. This can be related, e.g., to a switching state and/or a dimming state and/or a color temperature and/or an illumination sequence. In addition, lamp addressing for controlling the lamp can be stored in this database. As soon as the operating device 2 has thus received the identification light signal of the respective lamp 10-18 by means of its identification receiving unit, it performs a database inquiry in order to determine, display and/or activate the lamp 10-18 allocated to the identification light signal and thus controllable in the corresponding situation and, in addition, can determine and preferably visually reproduce the additional information. On the basis of the lamp addressing, the lamp can be activated directly. By means of the positioning information, the operating device 2 can represent the accurate positions of the lamps in the room on a display unit. By means of the information relating to the control options, the operating device 2 can only represent the possible control options of the respective lamp on a display unit and thus simplify the representation.

Alternatively, it is also conceivable that the database is allocated to the controller 3. In this case, an equalization takes place between the identification light signal received by the operating device 2, or the signal correspondingly derived therefrom, and the database information. On the basis of this inquiry, the lamps authorized for activation is/are identified and authenticated for being activated. This enables the operator to activate an unambiguously allocated and authenticated lamp via the controller with the aid of the operating device 2. The activating signal can then be transmitted, for example, from the controller 3 via DALI to the authorized lamp(s) 10-18 which thereupon execute the corresponding control commands delivered by the operating device.

The light signals used are modulated visible light. Particularly in the case of the light signals of lamps 10-18, the identification light signals are a modulation of the light, sent out for illumination in any case, of the lamps 10-18. Preferably, these can be VLC signals (VLC=Visible Light Communication).

If the lamps 10-18 which have previously been switched off are to be controlled, the operating device 2 produces with a control attempt a temporary switch-on of the respective lamp 10-18 (possibly selected deliberately (manually) at the operating device) for a second short period of time. During this second period of time, the lamp emits its identification light signal by means of its identification transmitting unit. If during this second period of time, a successful transmission of a signal derived from the identification light signal is transmitted by the operating device 2 as has been described before, the control is accepted by the lamp 10-18 previously switched off.

Otherwise, the lamp 10-18 deactivates itself again after this second period of time and preferably responds again to a further control attempt by the particular operating device 2 only after a further third period of time. This ensures that an unauthorized user does not have as many attempts as he/she likes for controlling the lamps and thus for "guessing" the identification light signal.

Controlling the lamps 10-18 is thus possible—as shown here—via the wireless interface and the controller 3. Alternatively, the lamps can also have their own wireless communication interfaces. Control is then effected directly without the controller 3. In this case, a database, described before, is preferably deposited in the operating device 2 itself or the operating device sends out an identical identification light signal for authentication. Control of the lamps with or without intermediate controller can be simplified by an App on a smartphone as operating device.

In a further preferred embodiment, operation is possible not only when the identification receiving unit 22 of the operating device 2 receives the corresponding identification light signal(s) currently, that is to say at the time of delivery of a control signal for controlling the lamp(s) 10-18, but, for example, also after leaving an area in which a corresponding identification light signal can be received. An operation/control of the lamp(s) 10-18 is also accepted in this case when the operation/control—that is to say the delivery of a control signal—has taken place within a defined (first) period of time after the last reception of an identification light signal. In this context, the first period of time is 10 minutes at the most, preferably 1 minute at the most, especially preferably 20 seconds at the most. The first period of time can be adjustable, for example, automatically or by a user or predetermined. Due to this embodiment, it is possible, on the one hand, to activate lamps 10-18, as described before, also after leaving an area in which corresponding identification light signals can be received. On the other hand, this also increases, for example, the flexibility with respect to the activation of lamps switched off, since a possibility is created to use an operating device 2 already "authorized" in the past in the area of the lamp(s) 10-18 to be activated, directly for activating or putting switched-off lamps 10-18 into operation directly.

In this case, the period of time defined can also be a period of time which extends to a last operation of the corresponding lamp 10-18.

Figure 2:
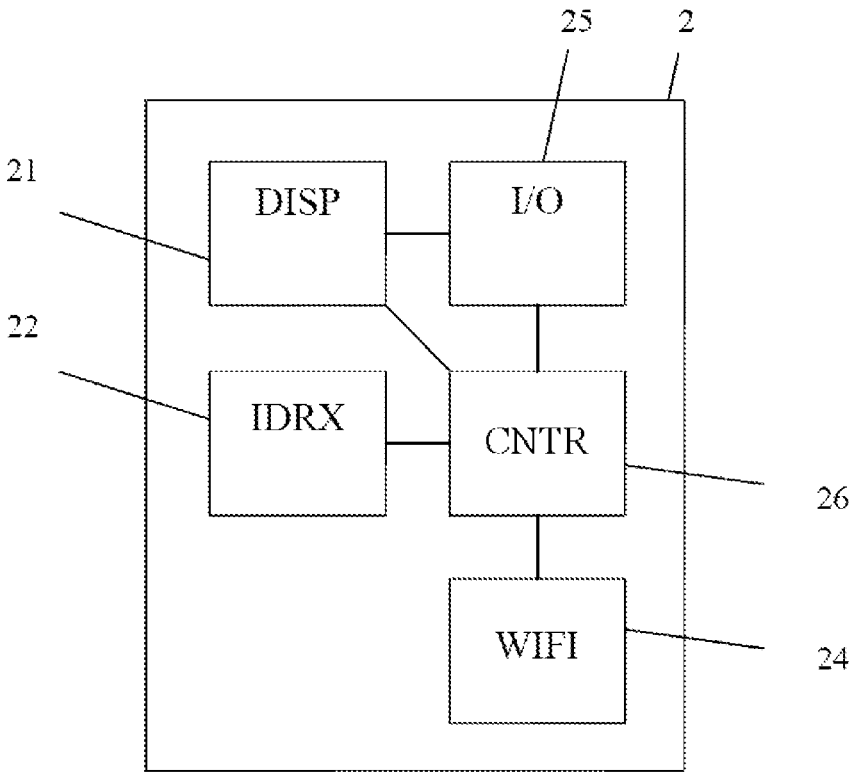
FIG. 2 shows a first detail view of the exemplary embodiment of the lighting system according to the invention in a block diagram.

FIG. 2 shows a first partial view of the exemplary embodiment of the lighting system according to the invention. Shown here is a block diagram of the operating device 2. The operating device 2 preferably contains a control device 26 which is preferably connected to an input/output facility 25, a display facility 21, an identification receiving unit 22 and a wireless communication interface 24. Furthermore, the display facility 21 is preferably connected to the input/output unit 25. The control facility 26 is preferably designed for controlling all other facilities.

By means of the identification receiving facility 22 (for example a camera or the like), the operating device 2 can receive light signals. By means of the display unit 21 and the input/output unit 25, there can be an interaction with a user. In particular, user guides for controlling the lamps can be displayed on the display unit 21. In addition, inputs can be picked up by touching the operating device 2, and processed, with the assistance of the input/output unit 25, e.g. with a touch-sensitive screen of the display unit 21. By means of the wireless communication interface 24, communication is possible with the lamps 10-18 and/or with the control device 3 (if present) from FIG. 1.

Figure 3:
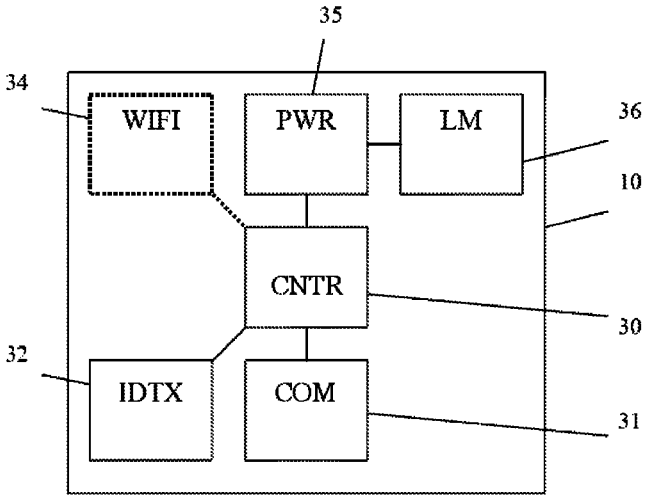
FIG. 3 shows a second detail view of the exemplary embodiment of the lighting system according to the invention in a block diagram.

FIG. 3 shows a second detail view of the exemplary embodiment of the communication system 1 according to the invention. It shows a block diagram of an exemplary lamp 10 from FIG. 1. The lamp 10 preferably includes a control unit 30 which is particularly preferably connected to a communication interface 31, an identification transmitting unit 32, a wireless communication interface 34 and a power supply 35. The power supply 35 is also connected to an illuminant 36 and can represent an integrated or an external power supply/power source. In this arrangement, the control facility 30 is preferably used for controlling the components connected to it directly. For example, the wireless communication interface 34 is optional and can be provided if direct communication of the operating device 2 with the lamps 10-18 is provided. In this case, the communication interface 31 can be omitted.

The communication interface 31 is preferably used for communication of the respective lamp 10-18 with the control device 3 and conversely. The identification transmitting unit 32 is preferably used for transmitting or generating light signals via an illuminant of the lamp. This can be the main illuminant provided for the light emission of the lamp or also an illuminant provided separately. An optionally provided identification receiving unit can be provided and is then used for receiving (modulated) light signals which, according to one exemplary embodiment, are sent out by the operating device 2 for activating a corresponding lamp 10-18. The optionally provided wireless communication interface 34 is preferably used for direct communication with the operating device 2. The power supply 35 is used for the controlled operation of the illuminant 36. In particular, it can be an adjustment of the switching state, of the dimming state, of the color temperature and of an illumination sequence.

Figure 4:
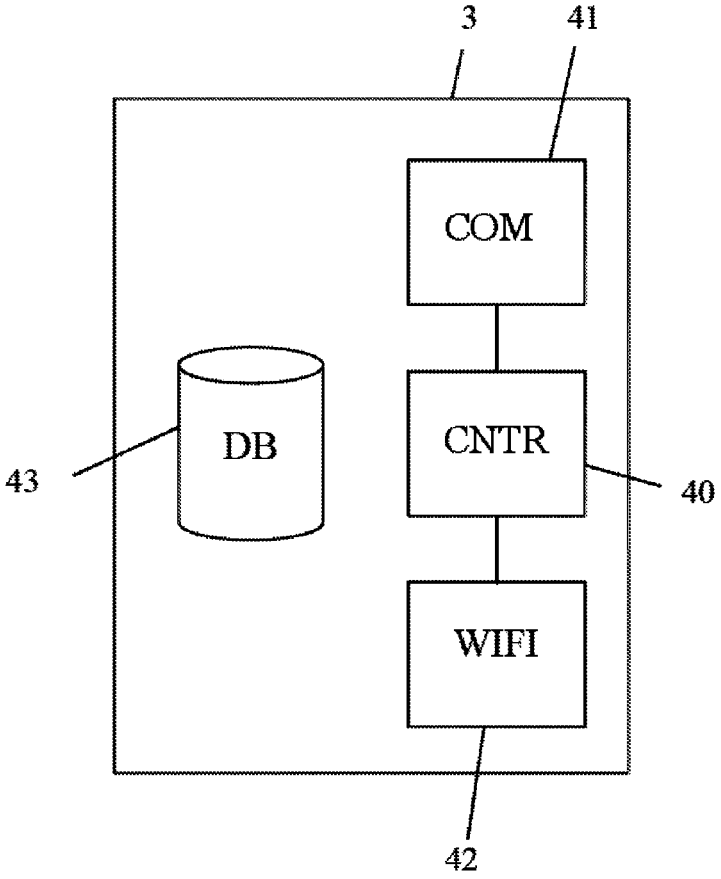
FIG. 4 shows a third detail view of the exemplary embodiment of the lighting system according to the invention in a block diagram.

FIG. 4 shows a third detail view of the exemplary embodiment of the lighting system 1 according to the invention. It shows a block diagram of the optional control device 3. The control device 3 preferably contains a control facility 40, a communication interface 41, a wireless communication interface 42 and a database 43. In this arrangement, the control facility 40 is preferably designed to control all other components 41-43.

The communication interface 41 is preferably used for communication with the lamps 10-18, e.g. via DALI. The wireless communication interface 42 is preferably used for communication with the operating device 2, especially when the latter is designed as mobile operating device and also has a wireless communication interface (e.g. WLAN module). In this arrangement, the database 43 is used for retrieving information relating to the lamps through the operating device 2 and for allocating and authenticating a control command with respect to an actual lamp allocated unambiguously. It should be noted that the operating device 2 can also have a database, particularly if no control device 3 is provided or also if it is provided and authentication should already take place in the operating device 2.

It is, therefore, pointed out again at this point that the lighting system 1 does not necessarily need a control device 3. If the lamps 10-18 have in each case a wireless communication interface 34, the control device 3 can be omitted. In this case, the lamps 10-18 only need the wireless one or another communication interface 34 for direct communication with the operating device which can also be designed in the form of the interface 31. In this case, the database can be arranged inside the operating device 2 as already mentioned.

Alternatively, it can also be installed independently of the operating device and/or control device within the lighting system.

Figure 5:
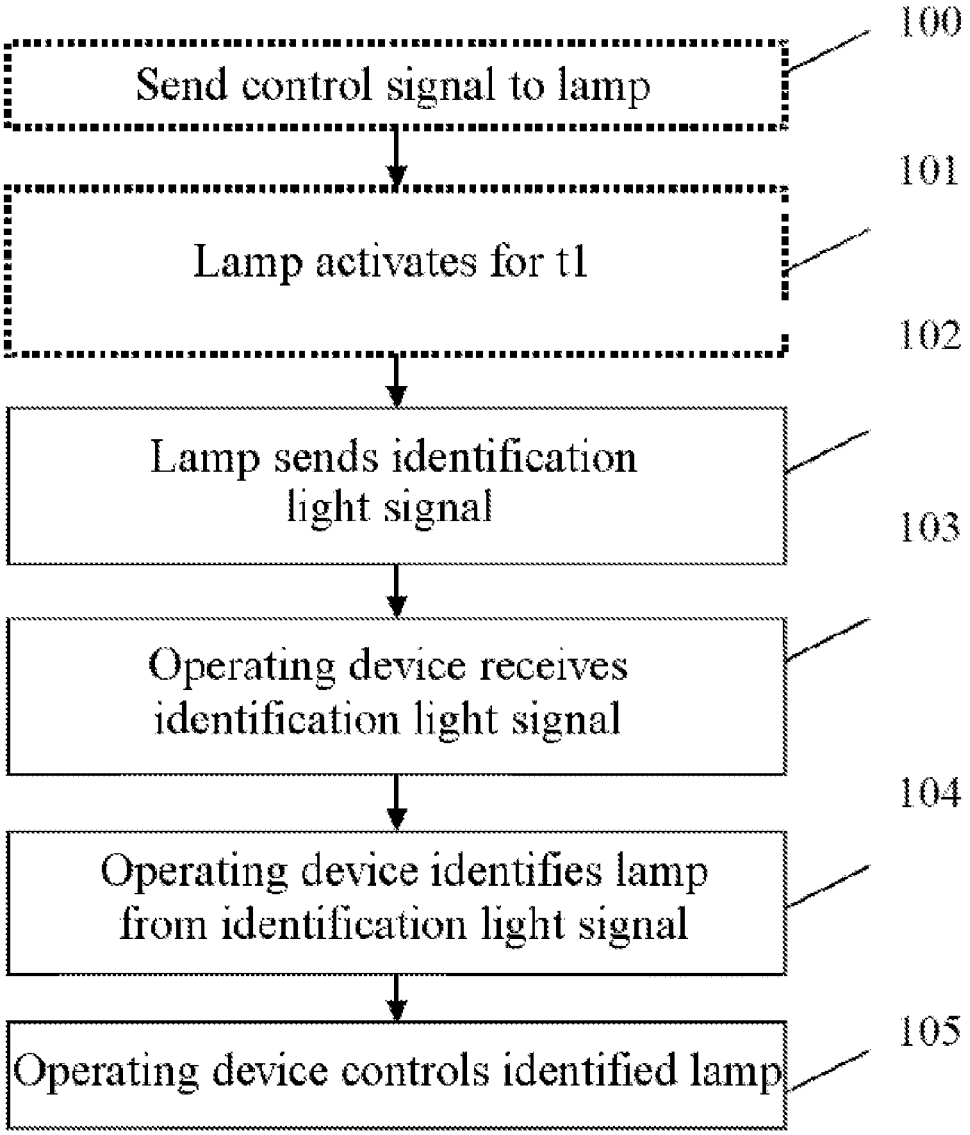
FIG. 5 shows a first exemplary embodiment of the method according to the invention in a flowchart.

FIG. 5 shows a first exemplary embodiment of the method according to the invention. In an optional first step 100, a control signal is sent to a lamp. In an optional second step 101, the lamp becomes activated for a (second) period of time $t_1$. Steps 100 and 101 are optional steps which are performed, for example, only when the lamp is switched off at the beginning. Alternatively, putting the lamp into operation can also be enabled if the time of delivery of a control signal for controlling the lamp occurs within a defined (first) period of time after a last reception of an identification light signal. In a third step 102, the lamp sends out an identification light signal which is received by the operating device in a fourth step 103. In a fifth step 104, the operating device identifies the lamp by means of the identification light signal and controls the identified lamp in a sixth step 105. In this case, the database is preferably provided in the operating device 2. The received identification light signal is then allocated to one or a plurality of lamps identified unambiguously by means of the identification light signal on the basis of the stored database. It is only the identified lamps which can then be controlled by means of the operating device. For example, an installation map can be displayed on a (touch) screen of the operating device 2 on the basis of the information obtained, which map provides for intuitive control. A corresponding authentication can be performed, for example, at regular intervals (for example in intervals corresponding to the (pre)defined first period) or also only when a control command is output.

Moreover, it is also conceivable that the operating device 2 outputs an identification light signal corresponding to the lamp 10-18 or a signal derived therefrom, together with a desired control signal. The lamps 10-18 then receive the control signals and only those which determine an agreement of the or a predefined correlation with the signal output by the operating device 2 with their own identification light signal will actually be activated.

Figure 6:
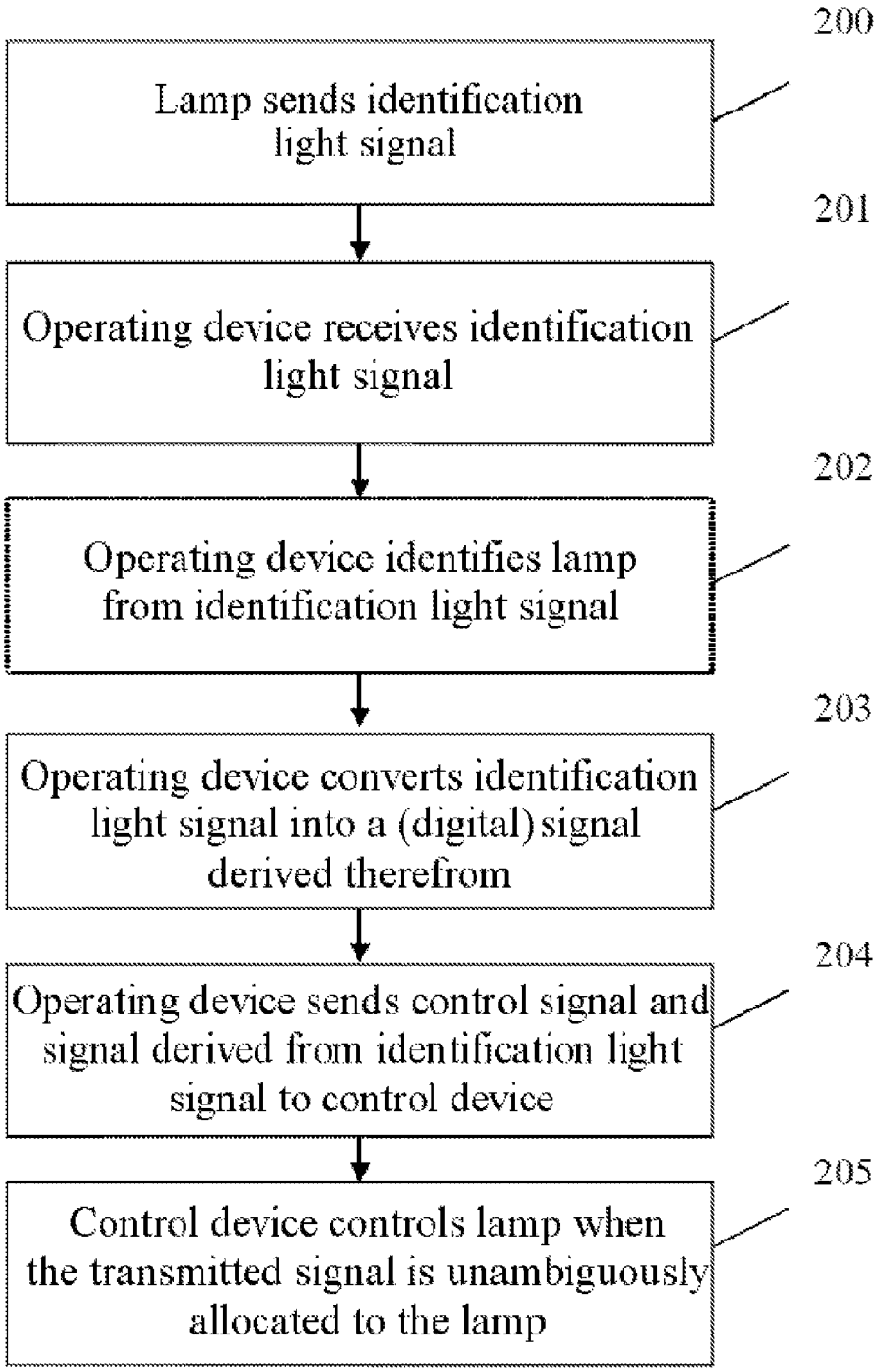
FIG. 6 shows a second exemplary embodiment of the method according to the invention in a flowchart.

FIG. 6 shows a second exemplary embodiment of the method according to the invention. Steps 100 and 101 from FIG. 5 have been omitted here. However, these can also be executed here first.

In a first step 200, a lamp 10-18 sends an identification light signal which is received by a (mobile) operating device 2 in a second step 201. In an optional third step 202, the operating device identifies the lamp by means of the identification light signal (for example on the basis of an equalization of the signal with a database). Before or after the optional third step, the operating device 2 converts the identification light signal of the lamp 10-18 in a fourth step 203 into a derived (digital) signal; for this purpose, it is possible to access a corresponding program or the aforementioned database in which corresponding data are stored. In a fifth step 204, the operating device 2 sends a control signal and a (digital) signal derived from the identification light signal to a control device 3. This is received and checked by the control device in a sixth step 205 (for example by equalization of the signal with information stored in a database and unambiguously allocatable to each lamp). If the check is positive, that is to say the signal can be unambiguously allocated to a lamp or a number of signals can be unambiguously allocated to a corresponding number of lamps, the control device controls the lamp; particularly when the identification light signal of the lamp(s) to be activated 10-18 has been received at the time of the delivery of the control signal for controlling the lamps or within a defined period of time before by the identification receiving unit 22 of the operating device 2.

It should be pointed out here that a number of lamps can also be allocated to a (predefined) group which deliver a common or identical identification light signal and can thus be activated together as a group when an authentication of a control command has taken place for corresponding lamps. The derived signal can also be a combined signal for a group of received identification light signals, corresponding information, which provides for an authentication of the activation of this group of lamps, being deposited for example in the database when this combined signal, which can be unambiguously allocated to the group of lamps, is received.

The principle of the present invention is, therefore, to configure a lamp installation in such a manner that the lamps send out an unambiguous identification signal by means of data transmission, for example by visible light (Visible Light Communication) (e.g. the MAC address of the microcontroller installed in the control unit). This can then be detected, in turn, by means of a suitable light-sensitive receiver (for example photodiodes, cameras, brightness sensors, color sensors, etc., particularly in smartphones, tablets etc.). It is then, for example by access rights deposited on a database in the system, that it can be ensured, e.g., that only authorized lamps can be controlled by the operating device. In particular, it can be ensured by using visible light as a transmission medium that only those lamps are controlled which are, or were within the defined first period of time, within a visible environment of the operating device. By this means, e.g., a lamp which is located on another side of a wall in the adjacent room or in the visible range of which the operating device has not passed or not passed for too long a period (>first period of time) can not be detected by the operating device and the unintentional controlling of the lamps in adjacent rooms can thus be prevented. Additionally, additional functionalities can be installed such as, e.g., that only lamps can be controlled the light level of which exceeds a particular value or the signal of which meets other requirements by which a more accurate localization is made possible.

The invention is not restricted to the exemplary embodiments shown. In particular, the most varied communication paths can be used between the operating device and the lamps, the operating device and a control device and the control device and the lamps. These can be, for example, wireless or wire-connected. The database can be provided on the operating device and/or the control device and/or at another place in the lighting system.

The operating device can be mobile or also permanently installed. All features described before and features shown in the figures can be advantageously arbitrarily combined with one another within the context of the invention.

The invention claimed is:

1. A lighting system controlled by a mobile operating device, the lighting system comprising:

a plurality of lamps, the operating device being designed to control the lamps, wherein the lamps in each case have an identification transmitting unit which is designed to control the respective lamp at least temporarily in such a manner that the lamp delivers an identification light signal unambiguously identifying the respective lamp, the operating device has an identification receiving unit which is configured to receive the identification light signals of the lamps, and a controller configured in such a manner that only lamps can be controlled by the operating device, the identification light signal of which is received by the identification receiving unit of the operating device at the time of delivery of a control signal for controlling the lamps or within a defined first period of time before;

wherein in the case of a control of the respective lamp starting from a switched-off state of the lamp, to switch independently of a transmission of a signal derived from the associated identification light signal by the operating device, into a switched-on state for a second period of time and during this second period to send out the identification light signal by means of the identification transmitting unit of the lamp, wherein the control is accepted by the lamp previously switched off, if during this second period of time a successful transmission of a signal derived from the identification light signal is transmitted by the operating device, and wherein the lamps change back into the switched-off state when there has been no transmission of a signal derived from the associated identification light signal by the end of the second period of time.

2. The lighting system as claimed in claim 1, wherein the lighting system also has a database in which the identification light signals and/or signals derived therefrom of the respective lamps and additional information of the respective lamps are stored, and in that the operating device is designed to retrieve at least a part of the additional information of the respective lamps after reception of an identification light signal by means of an inquiry from the database and/or exclusively to control a lamp unambiguously allocated to the identification light signal.

3. The lighting system as claimed in claim 2, wherein the additional information of the respective lamps contains a lamp addressing, and in that the operating device is designed to control the respective lamp by means of its lamp addressing.

4. The lighting system as claimed in claim 2, wherein the additional information of the respective lamps contains a position of the lamp, and in that the operating device has a display unit which is designed to display the positions of the lamps.

5. The lighting system as claimed in claim 2, wherein the additional information of the respective lamps contains available control options of the lamp, in that the control options can contain a switching state and/or a dimming state and/or a color temperature and/or a lighting sequence, and in that the operating device is designed to display available control options only for the respective lamp by means of a display unit.

6. The lighting system as claimed in claim 1, wherein the operating device has a wireless communication interface, and in that the controlling of the lamps by the operating device occurs by means of the wireless communication interface of the operating device.

7. The lighting system as claimed in claim 6, wherein the operating device is designed to send control commands for controlling the lamps and signals derived from the received identification light signals by means of the communication interface to a communication interface corresponding with the lamps in terms of control, the lighting system being designed in such a manner to accept a control of a lamp via the operating device only when the derived signal can be unambiguously allocated to the identification light signal of this lamp, wherein the derived signal can be unambiguously allocated to a lamp to be controlled on the basis of the database stored in the lighting system.

8. The lighting system as claimed in claim 6, wherein the lamps have in each case a wireless communication interface, in that the lamps are controlled by the operating device directly by means of the wireless communication interfaces of the operating device and of the lamps, in that the operating device is designed to send signals derived from received identification light signals to the lamps by means of the wireless communication interfaces, and in that the lamps are designed to accept a control via the operating device only when the respective lamp receives a signal derived from the respective identification light signal sent out.

9. The lighting system as claimed in claim 8, wherein the lamps are designed not to respond to a control by the operating device during a third period of time following the second period of time after the second period of time has elapsed.

10. The lighting system as claimed in claim 6, wherein the lighting system has a control device which has a wireless communication interface for communication with the operating device, the control device being designed to control the lamps directly and the operating device being designed to control the lamps indirectly via the control device, and in that the operating device is designed to send signals derived from received identification light signals to the control device by means of the wireless communication interfaces, and in that the control device is designed to control a lamp only when the control device receives a signal derived from the identification light signal of the lamp sent out.

11. The lighting system as claimed in claim 10, wherein the control device is designed not to respond to an operation of the lamps by the operating device during a third period of time following the second period of time after the second period of time has elapsed.

12. The lighting system as claimed in claim 1, wherein the lighting system is designed in such a manner that only lamps are controllable, the respective identification light signals of which are received by the identification receiving unit of the operating device with a light intensity which is greater than a predetermined threshold value.

13. The lighting system as claimed in claim 1, wherein the identification light signals of the lamps are a modulation of a light radiated by the lamps for illumination, and/or in that the identification light signals are Visible Light Communication signals.

14. The lighting system as claimed in claim 1, wherein the defined first period of time is not more than 10 minutes.

15. A method for operating a lighting system having an operating device and a plurality of lamps, the operating device controlling the lamps, wherein the lamps at least temporarily deliver an identification light signal unambiguously identifying the respective lamp, in that identification light signals of at least one or more of the lamps are received by the operating device, in that the operating device only controls lamps, the identification light signal of which is received by the operating device at the time of delivery of a control signal for controlling the lamps or within a defined first period of time before;

in that, independently of a transmission of a signal derived from the associated identification light signal by the operating device, it is switched into a switched-on state for a second period of time and during this second period the identification light signal is sent out by means of the identification transmitting unit of the lamp, in that the control is accepted by the lamp previously switched off, if during this second period of time a successful transmission of a signal derived from the identification light signal is transmitted by the operating device, and in that the lamps are designed to change back into the switched-off state, when there has been no transmission of a signal derived from the associated identification light signal by the end of the second period of time.

16. The lighting system as claimed in claim 1, wherein the defined first period of time is not more than 1 minute.

17. The lighting system as claimed in claim 1, wherein the defined first period of time is not more than 20 seconds.

18. A lighting system comprising:

a mobile operating device, a plurality of lamps, the operating device being configured to control the lamps, wherein the lamps in each case have an identification transmitting unit which is designed to control the respective lamp at least temporarily in such a manner that the lamp delivers an identification light signal unambiguously identifying the respective lamp, the operating device having an identification receiving unit which is configured to receive the identification light signals of the lamps, and the lighting system having a controller configured in such a manner that only lamps can be controlled by the operating device, the identification light signal of which is received by the identification receiving unit of the operating device at the time of delivery of a control signal for controlling the lamps or within a defined first period of time before;

wherein the lamps are designed, in case of a control of the respective lamp, starting from a switched-off state of the lamp to switch, independently of a transmission of a signal derived from the associated identification light signal by the operating device, into a switched-on state for a second period of time and during this second period to send out the identification light signal by means of the identification transmitting unit of the lamp and, wherein the control is accepted by the lamp previously switched off, if during this second period of time a successful transmission of a signal derived from the identification light signal is transmitted by the operating device, and wherein the lamps are designed to change back into the switched-off state when there has been no transmission of a signal derived from the associated identification light signal by the end of the second period of time.

19. The lighting system as claimed in claim 18, wherein the operating device is mobile.

* * * * *